United States Patent [19]

Harpold et al.

[11] Patent Number: 4,920,878

[45] Date of Patent: May 1, 1990

[54] SCREEN PRINTER WITH PLATER SIFTING STRUCTURE

[75] Inventors: Charles W. Harpold; James Belcher, both of Grand Rapids, Mich.

[73] Assignee: Harco Graphic Products Inc., Grand Rapids, Mich.

[21] Appl. No.: 189,728

[22] Filed: May 3, 1988

[51] Int. Cl.[5] ..... B41F 15/10; B41F 15/26

[52] U.S. Cl. ..... 101/115; 101/126

[58] Field of Search ..... 101/126, 115, 35, 123

[56] References Cited

U.S. PATENT DOCUMENTS

| | | | |
|---|---|---|---|
| Re. 29,160 | 3/1977 | Jaffa | 101/123 |
| 2,690,118 | 9/1954 | Schwartz et al. | 101/115 |
| 2,845,859 | 8/1958 | Gattuso | 101/126 |
| 2,991,711 | 7/1961 | Ehrhard et al. | 101/126 |
| 4,031,825 | 6/1977 | Jaffa | 101/126 |
| 4,099,460 | 7/1978 | Bubley et al. | 101/115 X |
| 4,407,195 | 10/1983 | Jaffa | 101/123 |
| 4,696,228 | 9/1987 | David et al. | 101/126 X |
| 4,735,139 | 4/1988 | Szarka | 101/126 |

OTHER PUBLICATIONS

"Antec-Screen Printing Equipment Engineered for the Hands", advertising publication, 12 pp., cited 06/21/85.

*Primary Examiner*—Clifford D. Crowder

*Attorney, Agent, or Firm*—Price, Heneveld, Cooper, DeWitt & Litton

[57] ABSTRACT

A printing machine for simultaneously performing multiple printing operations in a continuous manner includes: a number of platens supporting thereon articles to be printed; a plurality of printing heads designed to print a desired pattern onto the article; and an oval track about which the platens are moved. The track includes first and second portions, wherein the first portion is at a higher elevation than the second portion. The first portion is positioned to orient the platen horizontally for ease in mounting the article thereon. The second portion underlies the printing heads and orients the platens in a downward inclination to thereby clear the printing heads as they are moved along the track. A lifting assembly lifts each platen into engagement with a printing head for printing a pattern onto the article.

38 Claims, 4 Drawing Sheets

SCREEN PRINTER WITH PLATER SIFTING STRUCTURE

BACKGROUND OF THE INVENTION

The present invention pertains to screen printing machines for simultaneously performing multiple printing operations in a continuous manner.

The printing of shirts, jerseys and the like has been, in large part, a labor-intensive operation in which most of the printing steps are performed manually by an operator. This system not only generates high production costs, but also a low output of finished goods, since the operators generally only work one article at a time.

In an effort to alleviate these difficulties, past artisans have fabricated printing machines capable of simultaneously performing multiple printing operations at a number of adjacent stations. Examples of such machines are illustrated in: U.S. Pat. No. Re. 29,160 issued Mar. 29, 1977 to Jaffa, and entitled SCREEN PRINTING MACHINE WITH OVAL RAIL FOR INDEXING PALLETS; and U.S. Pat. No. 4,407,195 issued Oct. 4, 1983 to Jaffa, and entitled SCREEN PRINTING MACHINE. However, while these machines do increase the efficiency of the printing operations, they are also very cumbersome and complex in nature.

More specifically, these machines are provided with a plurality of adjacent printing heads which are designed for pivotal movement between an operative position in which the screens engage the articles and an inoperative position in which the heads are disengaged therefrom. These printing heads are large and cumbersome mechanisms including: frames mounting screens; squeegee and flood bar assemblies; carriage and track means for movably supporting such assemblies; and drive means for operating the carriages, squeegees and flood bar assemblies. Large structural members and large lifting elements are required to facilitate the requisite pivoting operations thereof. Furthermore, this continual tipping of the screens makes effective management of the ink contained therein difficult. Consequently, the difficulty of continually achieving a uniform printing operation is compounded.

Since the printing heads are subjected to a fixed arcuate pivoting motion, the pallets supporting the articles must be accurately aligned beneath the screens to facilitate the desired printing operation. Alignment problems are particularly acute when the adjacent printing stations are utilized for the printing of different colors upon the same article to thereby form a multi-colored picture or pattern thereon. These prior art machines have fixedly mounted the supporting pallets onto the endless chain drives and have provided complex and costly precision mechanisms to control the drive means in an effort to ensure true alignment. However, despite these efforts, true and uniform alignment is not consistently possible due to the inherent variances incurred through the use of an endless chain drive.

SUMMARY OF THE INVENTION

The aforementioned problems and deficiencies are overcome in the present invention, wherein a printing machine having a number of stations performs simultaneous printing operations in a more efficient, and with a less complex and less cumbersome construction than heretofore achieved.

The present machine includes a track along which one or more platens supporting articles (such as shirts, jerseys, or the like) to be printed are driven. The platen is not only driven linearly along the track, but is also subjected to a vertical reciprocal motion at each printing station to thereby engage the article with the printing screen. This design allows the more complex and heavier printing heads to be held in a stationary position at all times. Consequently, this arrangement not only permits the use of smaller structural members and lifting means, but also obviates the ink managing concerns created in the prior art machines.

Furthermore, by only subjecting the platens to movement, the present apparatus is less susceptible to disrepair and necessitates fewer maintenance cares. Also, since the platens are smaller, lighter and easier to manage than the printing heads, they can be individually indexed at each printing station to ensure that the article is accurately aligned with the printing screen.

DETAILED DESCRIPTION OF THE PREFERRED EMBODIMENT

Figure 1:
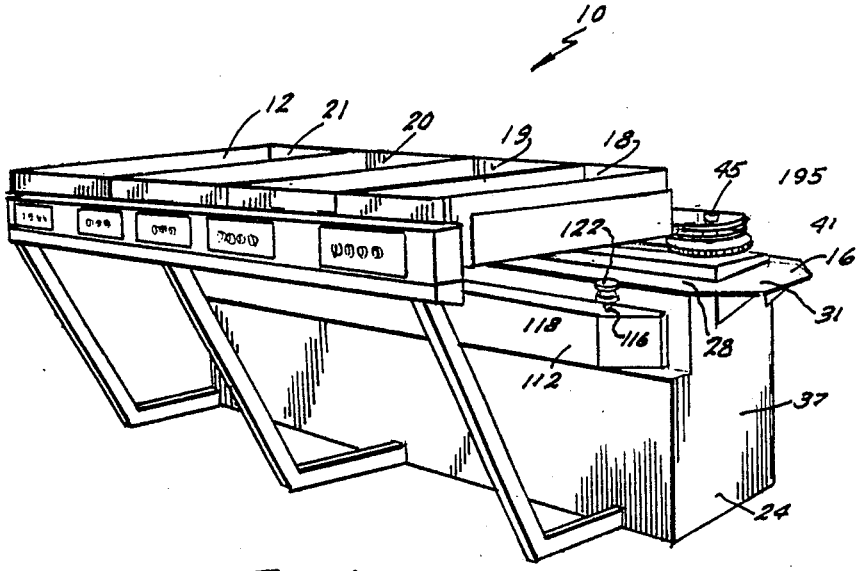
FIG. 1 is a perspective front view of the printing machine of the present invention.
Figure 2:
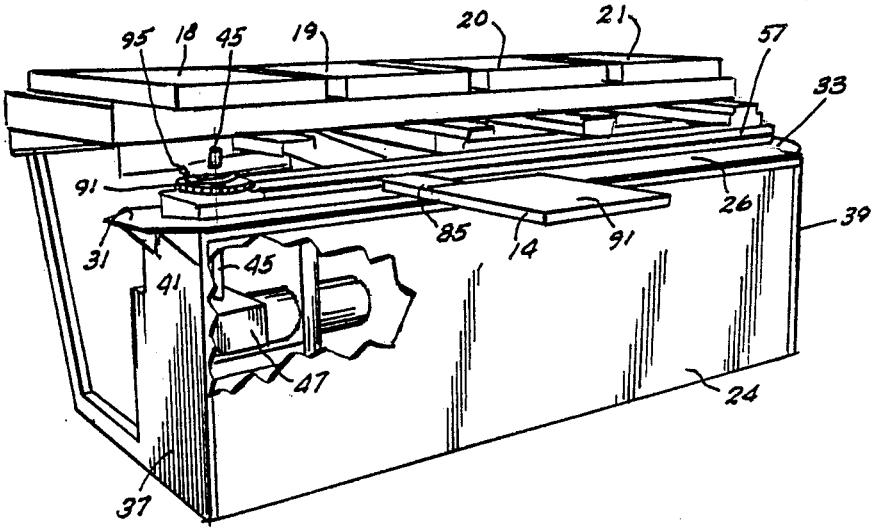
FIG. 2 is a rear perspective view thereof.
Figure 3:
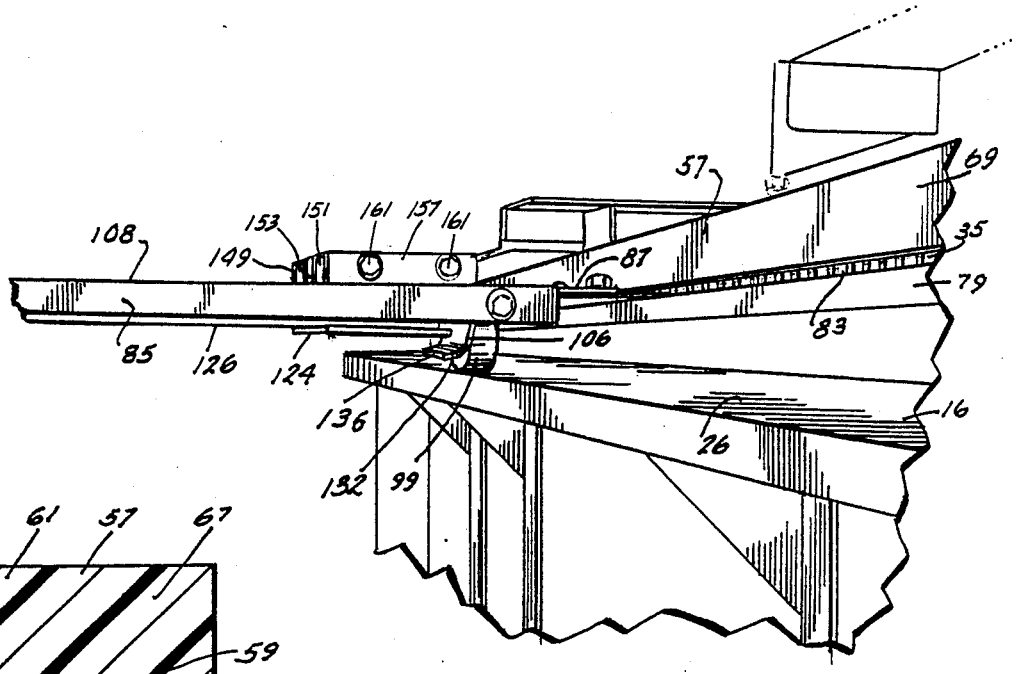
FIG. 3 is an enlarged, fragmentary rear perspective view thereof showing a platen as it travels across the rear of the machine.

In the preferred embodiment, printing machine 10 includes a plurality of printing heads 12, a plurality of platens 14 and an oval track 16 upon which platens 14 are movably supported (FIGS. 1 and 2). In the illustrated embodiment, four printing heads 12 defining printing stations 18–21 and eight platens 14 (not all shown) are provided. Of course, any number of printing heads and platens could be utilized.

Track 16 is fixedly secured to base 24 of machine 10 about the periphery thereof. Track 16 includes an elongated rear portion 26 which extends across the entire rearward length of base 24, a complimentary elongated front portion 28 which extends across the entire frontal length of base 24 but at a lower elevation than rear portion 26, and a pair of inclined transverse portions 31, 33 interconnecting the two longitudinal portions 26, 28. The gradient differences are utilized to properly position platens 14 as they move around track 16, as will be more fully described below.

Above track 16 and essentially positioned within the oval defined thereby is an endless chain 35 positioned to lie in a substantially horizontal plane. At each end 37, 39 of machine 10 is rotatably mounted a sprocket 41, 43 which meshes with and supports chain 35. One sprocket 41 is fixedly mounted upon a drive shaft 45 which extends downwardly to a motor 47. Preferably, motor 47 is an electric motor, although any drive means with the requisite characteristics could be used. The other sprocket 43 is an idling sprocket which is mounted on idling axle 49 for free rotational movement.

Figure 4:
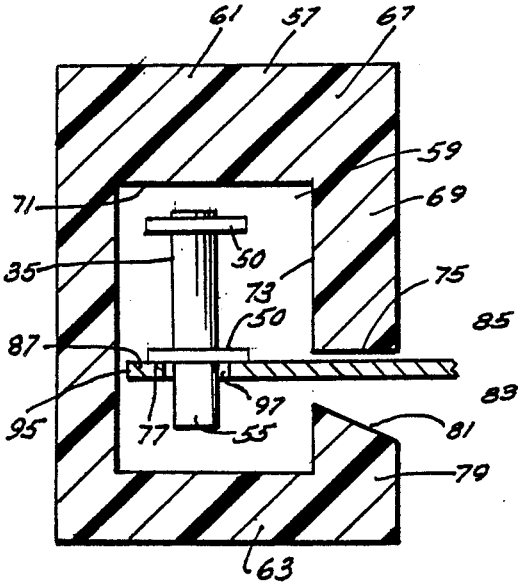
FIG. 4 is a fragmentary cross-sectional view of a platen mounted to a chain in a guideway positioned along the rear of the machine.

Chain 35 is comprised of a plurality of links 51 interconnected by pins 53, 55. Certain of the pins 55 are elongated and extend downwardly beyond links 51 to facilitate the mounting of platens 14 (FIG. 4). Consequently, mounting pins 55 are grouped into spaced apart pairs to engage and control the platens' linear movement about track 16. Further, the pairs of mounting pins 55 are spaced apart a predetermined distance so as to position all of the platens 14 at the appropriate stations when the drive chain 35 is stopped.

Guideways 57 are also positioned along the rearward and frontal lengths of base 24 (FIGS. 1 and 2). More specifically, guideways 57 are provided with an elongated channel 59 which is aligned with and adapted to receive therethrough chain 35. Guideways 57 are preferably made of TEFLON or other similar material, to reduce the frictional resistance incurred during operation, as will be more fully discussed below.

Guideways 57 are substantially C-shaped members which include an upper leg 61 and a lower opposed leg 63, between which is defined channel 59 (FIG. 4). Upper leg 61 includes a pair of flanges 67, 69 which are interconnected in a substantially L-shaped configuration. Horizontal flange 67 defines an upper confining wall 71 of channel 59 and vertical flange 69 defines an outer confining wall 73 thereof. Vertical flange 69 is dimensioned such that end wall 75 thereof is positioned in substantially the same plane as the lower edge 77 of chain 35. Consequently, chain 35 is received almost entirely in the upper portion of guideway 57. Lower leg 63 is provided with an upwardly extending ridge 79 having an inclined end face 81. Between end wall 75 and inclined end face 81 is defined a gap 83 which is juxtaposed to and in communication with channel 59.

Figure 10:
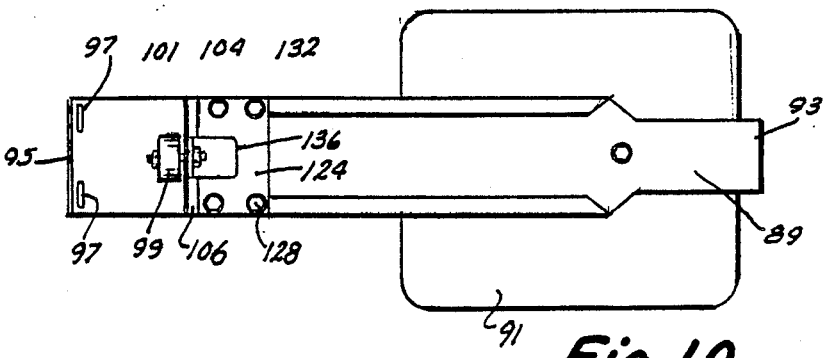
FIG. 10 is a bottom view of a platen of the present invention.

Platens 14 each include an elongated body 85 having opposite inner and outer ends 87, 89 (FIG. 10). Near outer end 89 of body 85 is fixedly mounted a pallet 91 which is adapted to receive and support thereon articles to be printed. Outer end 89 further defines a reduced neck portion 93 which extends outwardly beyond pallet 91 and is used by the operator to receive the neck of a shirt or the like to properly position and hold the article thereon.

Spaced outwardly a short distance from inner edge 95 of body 85 is a single roller 99 rotatably mounted upon axle 101 (FIG. 10). Axle 101 is oriented substantially longitudinally of body 85, so that roller 99 is adapted to rollingly engage and move about track 16. Axle 101 is preferably fixed at one end 104 to transverse flange 106, although it could be mounted in any known manner.

Figure 11:
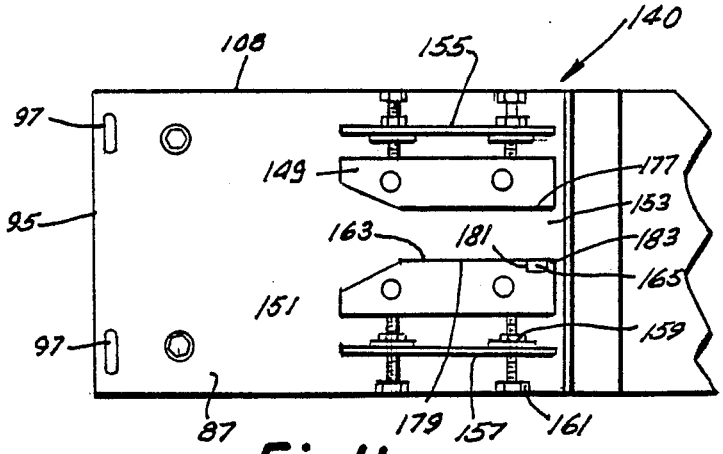
FIG. 11 is an enlarged top view of one end of a platen of the present invention.

Along the inner edge 95 of inner end 87 are a pair of elongated spaced apart apertures 97 (FIGS. 10 and 11). Inner end 87 further is constructed with a reduced thickness so as to be adapted for receipt through gap 83 and into channel 59. In this position, mounting pins 55 are loosely received through apertures 97 to thereby couple platen 14 to chain 35 (FIG. 4).

Platen 14 is, in this way, supported solely by a two-point engagement to project outwardly from track 16 in a cantilever fashion. More specifically, track 16 provides a lower support through its engagement with roller 99, and chain 35 provides a spaced apart upper support through the engagement of its lower edge 77 with top face 108 of body 85 (FIGS. 3, 4, 5, 6 and 8). Under a normal weight load, chain 35 is wrapped tautly enough about sprockets 41, 43 to adequately support platen 14. However, if a heavy load is transmitted through platen 14 to chain 35, its upper edge 109 will engage upper confining wall 71 for additional support (FIG. 4). This arrangement precludes the risk of damaging chain 35 or accidentally dislodging platen 14 therefrom. Nevertheless, platen 14 may be intentionally removed at either end 37, 39 of machine 10 (outside of guideways 57) by lifting outer end 89 so as to remove mounting pins 55 from apertures 97.

Figure 5:
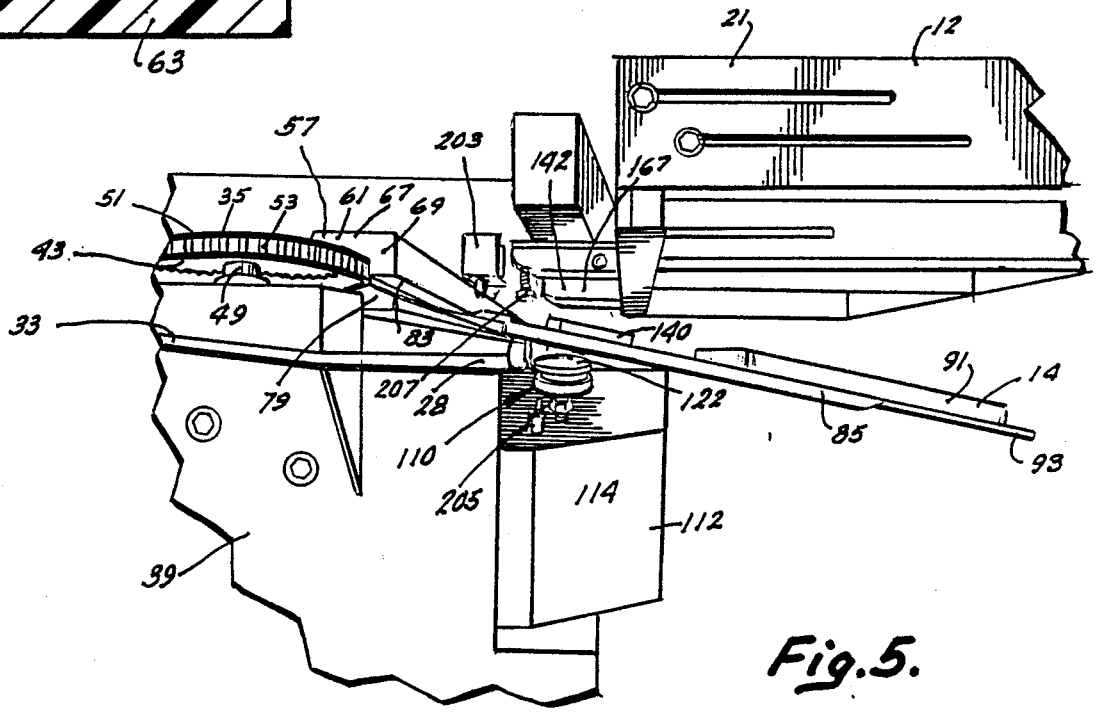
FIG. 5 is a side view of a platen traversing the front of the machine.
Figure 6:
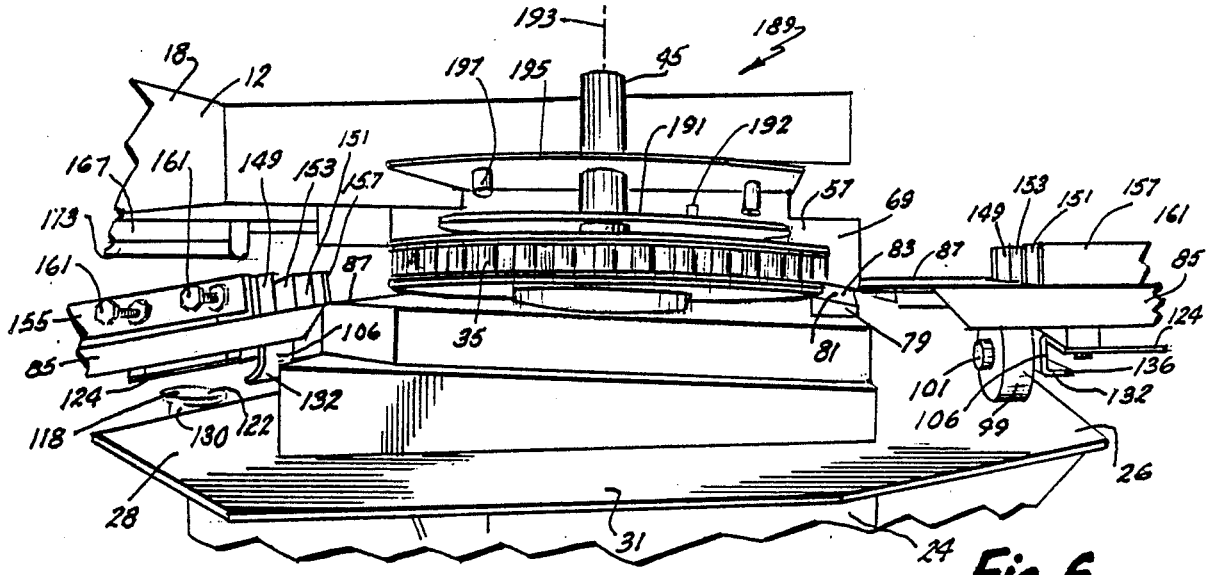
FIG. 6 is a fragmentary end view of the machine showing the chain drive and track portions thereof.
Figure 7:
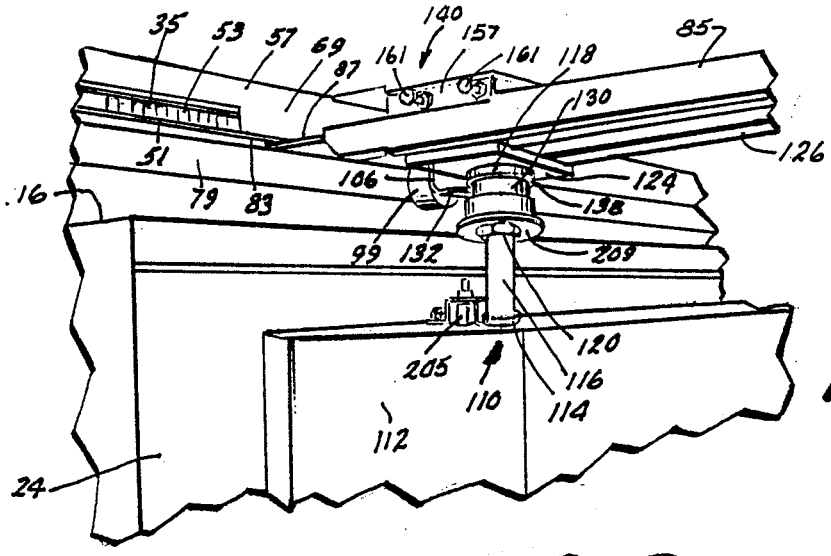
FIG. 7 is a perspective view of a platen lifted into engagement with a printing head along the front of the machine.

Due to the changes in elevation of track 16, the inclination of platen 14 will vary as roller 99 traverses the different portions thereof. When platen 14 projects rearwardly from machine 10, track 16 is at an elevation that positions platen 14 in a substantially horizontal orientation (FIG. 2). Chain 35 will upon movement, then, drive platen 14 toward second end 39 (to the right as illustrated in FIG. 2). The inclined transverse portion 33 of track 16 thereat is sloped downwardly to front portion 28 (FIG. 5). Hence, as roller 99 is moved around this corner, outer end 89 of platen 14 is lowered, to thereby place platen 14 at an inclination of approximately 20 degrees to the horizontal (FIG. 5). This inclined position of platen 14 is maintained for movement across the front of machine 10, except when stopped at a printing station, as will be described below. Then, upon platen 14 reaching the first end 37 of machine 10, roller 99 traverses upwardly sloping transverse portion 31 to rear portion 26 (FIGS. 1 and 6). Consequently, at this point, platen 14 will once again assume a substantially horizontal orientation. Note that the interconnection between mounting pins 55 and apertures 97 is sufficiently loose to permit this vertical movement of platen 14.

The provision of a non-planar track 16 facilitates the accomplishment of two distinct operations in an easy and efficient manner. First, the positioning of platen 14 horizontally (FIG. 2) along the rear portion 26 enables the operator to easily remove and mount the various articles (e.g. shirts, jerseys, etc.) to be printed. Secondly, platen 14 is dropped downwardly to assume an inclined orientation (FIG. 5) so that it may clear printing heads 12 as it travels across front portion 28. As will be discussed below, platen 14 may be driven upwardly into the horizontal position at each printing station to facilitate the printing operation.

The illustrated embodiment of machine 10 includes four printing stations 18–21. At each printing station 18–21 is provided a printing head 12 (which has been shown schematically only in the Figs.). Each head includes: a framework for supporting a printing screen; a squeegee and flood bar assembly for performing the requisite printing steps; a carriage movably mounted on a pair of tracks for supporting thereon the squeegee and flood bar assembly for movement across the screen; and a motive means for providing a driving impetus to the carriage. This arrangement is conventional in nature and will not be further discussed.

Also, at each printing station 18-21 is provided a fluid ram assembly 110, which is preferably of the pneumatic type (FIGS. 5, 7, 8 and 9). Ram assembly 110 includes a piston and cylinder (not shown) positioned within housing 112. Projecting upwardly therefrom, through an opening 114 in housing 112 is a reciprocal piston rod 116 having a head 118 mounted on its distal end 120. Head 118 is adapted to engage platen 14 and thereby effect its lifting and lowering at each printing station.

Head 118 is provided with an end face 122 which is adapted to engage upon the actuation of ram assembly 110 a lifting plate 124. Lifting plate 124 is fixedly secured to the undersurface 126 of platen body 85 through the use of bolts 128 or other fastening means such as rivets, welding or the like. Since ram assembly 110 is positioned outwardly of track 16, lifting plate 124 positioned to overlie head 118, is positioned slightly outwardly of transverse flange 106 mounting roller 99. Also, lifting plate 124 is dimensioned larger than end face 122 of head 118 so as to securely engage head 118 at all times, despite the movement which occurs between the two members due to the arcuate swinging motion of platen 14 and the linear reciprocal motion of head 118. Head 118 is preferably composed of TEFLON or other non-abrasive material, so that undue wearing of lifting plate 124 is not caused and to facilitate a smooth shifting between the two engaged elements 116, 124 during lifting and indexing of platen 14.

Groove 130 is included in head 118 so as to provide a positive lowering force to platen 14 in the event platen 14 should stick to printing head 12. To cooperate therewith, platen 14 is provided with a lowering flange 132 which is fixedly attached to transverse flange 106 and extends outwardly therefrom in the general direction toward lifting plate 124. In the illustrated embodiment, lowering flange 132 and transverse flange 106 are formed as a unitary piece, although such a structure is not critical.

More specifically, when ram assembly 110 is actuated to move head 118 upwardly toward lifting plate 124, its outermost peripheral surface 134 clears the free end 136 of lowering flange 132 due to the inclined orientation of platen 14. As head 118 engages lifting plate 124 and thereby lifts platen 14, platen 14 is arcuately swung upwardly into a horizontal position. During this arcuate swinging motion, free end 136 of lowering flange 132 is received within groove 130. In a typical operation, platen 14 experiences no sticking and lowering flange 132 never engages head 118; that is, under the force of gravity platen 14 will swing downwardly, moving lowering flange 132 out of groove 130 in the reverse manner as described for the lifting operation. However, should platen 14 stick in its horizontal position to printing head 12, the upper side surface 138 of groove 130 will engage free end 136 of lowering flange 132 as ram assembly 110 lowers head 118. This forceful engagement will pull platen 14 from printing head 12 and allow the force of gravity to once again lower platen 14 onto track 16 in a normal manner.

Figure 8:
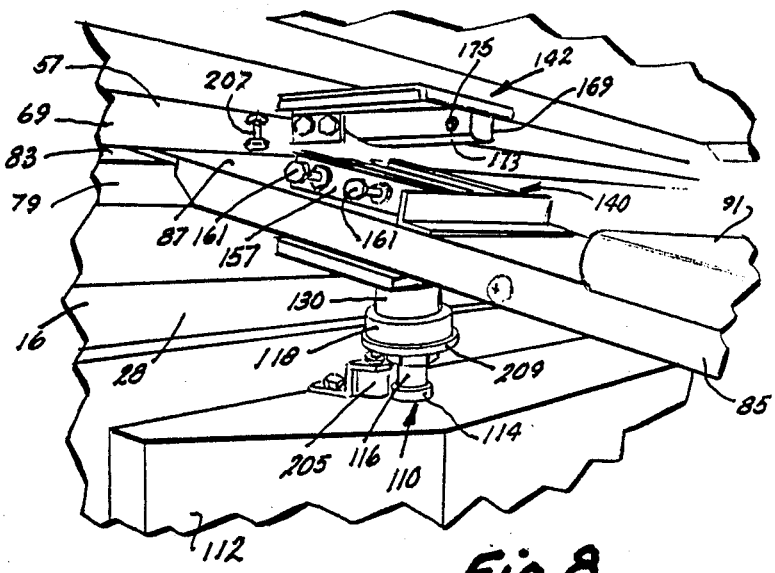
FIG. 8 is a perspective view of a lowered platen substantially aligned with a printing head along the front of the machine.

At each printing station 18-21 in which platen 14 is moved upwardly into engagement with printing head 12, a pair of cooperating indexing assemblies 140, 142 (FIGS. 8 and 11) interact to accurately position pallet 91 in relation to the screen supported in printing head 12. First indexing assembly 140 is mounted upon the upper surface 108 of platen body 85 (FIG. 11). In the most preferred embodiment, first indexing assembly 140 is positioned directly opposite lifting plate 124, but of course this relationship is not critical and indexing assembly 140 could be positioned elsewhere along platen body 85. A second indexing assembly 142 is mounted to a lower surface 146 of each printing head 12 (FIG. 8). Second indexing assembly 142 is positioned to overlie first indexing assembly 140 so as to interact at the time ram assembly 110 causes their engagement with each other. To ensure the mating engagement of indexing assemblies 140, 142, without placing unnecessary pressure on the chain support, a stop 207 extends downwardly from each printing head 18-21 to act as a pivot point for pallet 91.

First indexing assembly 140 includes a pair of shiftable indexing blocks 149, 151 which define therebetween a channel 153 (FIG. 11). Indexing blocks 149, 151 are each secured by a pair of mounting bolts 161 to a mounting flange 155, 157 fixedly secured to platen body 85. Mounting bolts 161 are threadedly received through openings 159 in mounting flanges 155, 157 in order to provide indexing blocks 149, 151 with adjustment capabilities. The adjustment of indexing blocks 149, 151 is effected only during the set up of machine 10, and would not be performed during the printing operations. Also, along channel wall 163 of indexing block 151 is provided an arcuate depression 165.

Second indexing mechanism 142 includes a protuberant bar 167 fixedly attached to surface 146 of printing head 12 (FIG. 8). Bar 167 includes a pair of sidewalls 169, 171 and an arcuate bottom surface 173 which directly overlies and faces toward first indexing assembly 140. Along one sidewall 169 of bar 167 is a cylindrical knob 175.

When indexing blocks 149, 151 have been properly adjusted, bar 167 is dimensioned to be matingly received within channel 153. Furthermore, when blocks 149, 151 and bar 167 are so interlocked, knob 175 is matingly received within depression 165.

In operation, channel 153 and bar 167 may not be perfectly aligned when ram assembly 110 begins to raise platen 14. In such an event, as platen 14 is raised upwardly, the gradual slope of arcuate bottom surface 173 of bar 169 will engage an inner edge 177, 179 of one indexing block 149, 151 to laterally shift platen 14 so that bar 167 is received within channel 153. As seen in FIGS. 10 and 11, apertures 97 are elongated to loosely receive pins 55 therein in order to permit such free lateral movement of platen 14.

In addition to lateral misalignment, platen 14 may also be longitudinally misaligned with respect to the printing screen. Knob 175 and depression 165 are designed to interact and ensure accurate longitudinal alignment of platen 14. In the event of such a misalignment, knob 175 will engage a top edge 181, 183 of depression 165 and, due to its rounded periphery 185, will guidingly shift platen 14 longitudinally so that knob 175 is matingly received within depression 165. This positive interconnection of indexing elements obviates the inherent risk involved in accurately positioning a platen at each station, when the platen is driven from station to station.

In order to effect automated operation of machine 10, certain control means are provided to determine and control when the above described operations are to occur. Firstly, a control means 189 is provided to control the platens' movements from station to station (FIG. 6). In the most preferred embodiment, this is accomplished by fixedly attaching a control plate 191 to drive shaft 45 so that it rotates concurrently with drive sprocket 41. Secured atop control plate 191 is a probe 192. Probe 192 is spaced a predetermined distance from the rotational axis 193 defined along drive shaft 45 so that one revolution thereof equals a certain linear distance of travel for endless chain 35, and hence also platens 14.

Mounted directly over control plate 191 in opposed relation thereto, is a fixed, immobile monitor plate 195. Secured to the bottom of monitor plate 195 and projecting downwardly toward control plate 191 is at least one sensing monitor 197 which is spaced from rotational axis 193 the same distance as is probe 192. In this construction, then, as drive sprocket 41 is rotated, probe 192 is passed directly beneath sensing monitor 197, which in turn senses its passage and transmits a message to the control center (not illustrated). Sensing monitor 197 may be an optical sensing device or other type of known sensing means. The control center operates to stop motor 47 once the desired amount of movement has occurred to place certain platens 14 beneath corresponding printing stations 18–21. Of course, control means 189 could be constructed to cooperate with idling sprocket 43 and idling axle 49 in the same manner as discussed above.

Figure 9:
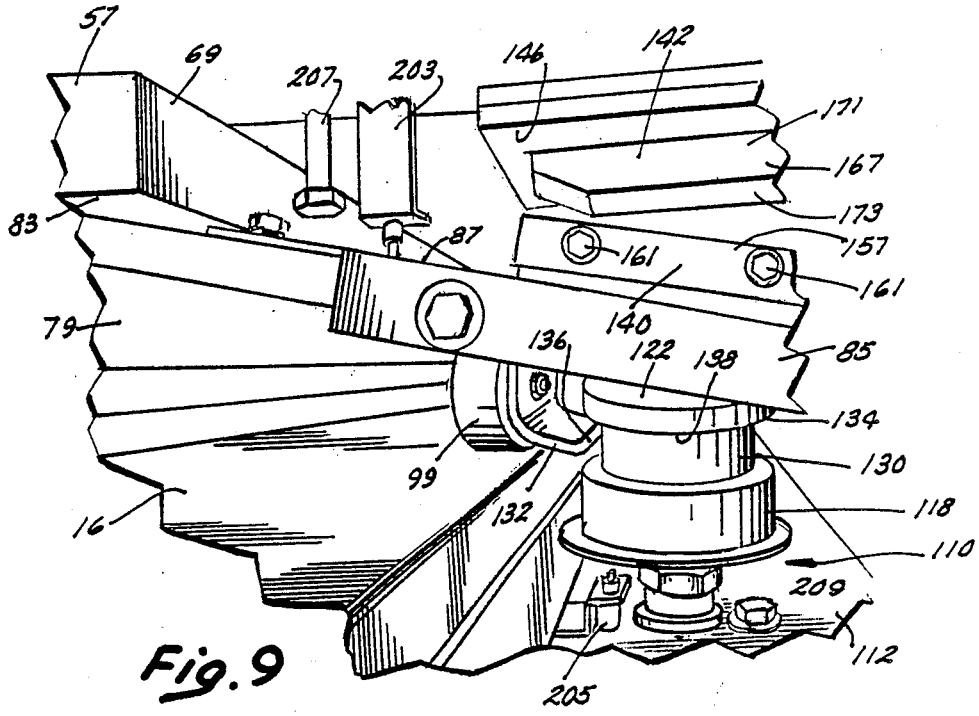
FIG. 9 is a side view of a lowered platen substantially aligned with a printing head along the front of the machine.

Furthermore, as a second control means each printing station 18–21 is provided with an upper and lower switch 203, 205 (FIGS. 5, 8 and 9). Upper switch 203 abuts the upper surface 144 of platen body 85 and is actuated when platen 14 has reached its horizontal position. Upon the closure of upper switch 203, the control center activates the printing head to print the desired pattern.

Lower switch 205 is positioned adjacent piston rod 116 and below a portion of base plate 209. Base plate 209 is fixedly secured between head 118 and distal end 120 of piston rod 116, for reciprocal movement therewith. As ram assembly 110 lowers head 118, base plate 209 will abut and actuate lower switch 205 once end face 122 thereof has cleared lifting plate 124. The actuation of lower switch 205 will transmit a message to the control center which will again actuate motor 47 to drive platens 14 to the next desired station.

The platens' movements may be controlled in a variety of different ways. For example: platens 14 may be driven so as to move successively to each printing station 18–21; or they may be moved to every other printing station (e.g. 18 and 20 or 19 and 21) so that adjacent printing stations (e.g. 18, 19 and 20, 21) are printing the same design; or all four printing stations 18–21 may be printing the same design such that the four platens on the front will exchange positions with the four platens projecting rearwardly when motor 47 is actuated. Any combination of movements could be utilized with this system.

Of course, it is understood that the above are merely preferred embodiments of the invention, and that various other embodiments as well as many changes and alterations may be made without departing from the spirit and broader aspects of the invention as defined in the claims.

The embodiments of the invention in which an exclusive property or privilege is claimed are defined as follows.

1. A printing machine comprising:

at least one printing head fixedly mounted on said machine and having means for printing a pattern on an article;

a plurality of individual moveable platens on said machine for movement in a first direction along a path extending transversely past and below said printing head and in a second direction along a generally vertical path upwardly towards said printing head; and lifting means for selectively moving each of said platens upwardly into engagement with said printing head when each platen is substantially aligned with said printing head, without simultaneously moving platens upwardly which are not aligned with said printing head, whereby said printing means prints the desired pattern on an article positioned on a platen when the platen is moved upwardly into engagement with said printing head;

said lifting means being reversible whereby each selected platen is moved downwardly out of engagement with said printing head when printing is completed.

2. The printing machine of claim 1 which includes drive means for moving each platen along said path and means for attaching each platen to said drive means.

3. The printing machine of claim 2 in which each platen further includes a first indexing means and said printing head includes a second indexing means, said first and second indexing means cooperating with each other when a lifting means raises said platen into engagement with said printing head to thereby accurately position the article with respect to said printing means.

4. The printing machine of claim 3 in which one of said first and second indexing means includes a pair of indexing blocks which define therebetween a channel, and the other of said first and second means includes a protuberant bar which is shaped to interact with said indexing blocks to laterally shift each platen if said article is not accurately aligned with said printing means when said lifting means raises a platen into engagement with said printing head, such that said bar is thereby matingly received within said channel to positively and accurately position the article with said printing means.

5. The printing machine of claim 4 in which one of said bar and one said indexing block includes a laterally projecting knob, and the other of said bar and one said indexing block include a depression, wherein said knob is shaped to interact with said depression and longitudinally shift said platen if said article is not accurately aligned with said printing means when said lifting means raises said platen into engagement with said printing head, such that said knob is thereby matingly received within said depression to positively and accurately position the article with said printing means.

6. The printing machine of claim 3 in which said means attaching said platen to said drive means comprises pivotal attachment means whereby movement of said platen in said generally vertical path is achieved by pivoting said platen upwardly or downwardly into or out of engagement with said printing head.

7. The printing machine of claim 6 in which said drive means includes at least one elongated pin, said attaching means for said platen including at least one aperture which loosely receives said elongated pin therethrough for attaching said platen to said drive means, whereby said platen is driven around said track and provided with a sufficiently loose attachment so as to permit the vertical reciprocal movement of said platen between its lowered and elevated positions.

8. The printing machine of claim 7 in which said aperture is elongated in a direction generally parallel to said first path of movement whereby as said first and second indexing means engage, said platen is free to shift slightly along said path to allow said indexing means to bring it into precise alignment with said printing head.

9. The printing machine of claim 8 in which one of said first and second indexing means includes a pair of indexing blocks which define therebetween a channel, and the other of said first and second means includes a protuberant bar which is shaped to interact with said indexing blocks to laterally shift said platen if said article is not accurately aligned with said printing means when said lifting means raises said platen into engagement with said printing head, such that said bar is thereby matingly received within said channel to positively and accurately position the article with said printing means.

10. The printing machine of claim 9 in which one of said bar and one said indexing block includes a laterally projecting knob, and the other of said bar and one said indexing block include a depression, wherein said knob is shaped to interact with said depression and longitudinally shift said platen if said article is not accurately aligned with said printing means when said lifting means raises said platen into engagement with said printing head, such that said knob is thereby matingly received within said depression to positively and accurately position the article with said printing means.

11. The printing machine of claim 8 in which one of said bar and one said indexing block includes a laterally projecting knob, and the other of said bar and one said indexing block include a depression, wherein said knob is shaped to interact with said depression and longitudinally shift said platen if said article is not accurately aligned with said printing means when said lifting means raises said platen into engagement with said printing head, such that said knob is thereby matingly received within said depression to positively and accurately position the article with said printing means.

12. The printing machine of claim 6 in which said lifting means includes a head which is adapted to engage and raise said platen into engagement with said printing head through a linear vertical movement of said head and an arcuate swinging motion to said platen, said head including a groove having a top defining wall, and said platen further including a lowering flange which is adapted to swing into said groove as said platen is raised, and is adapted to engage said top defining wall when said platen is lowered if said platen sticks to said printing head, whereby said platen can thereby be positively lowered from said printing head.

13. The printing machine of claim 12 in which said printing head comprises a printing screen oriented in said printing head generally horizontally, said fixedly mounted printing head keeping said screen in said horizontal orientation and facilitating management of ink used to flood said screen.

14. The apparatus of claim 12 in which said path defines a continuous loop having spaced front and rear segments, said printing head being located over said front segment and said rear segment of said path being free of obstructions whereby when said platen is located along said rear segment of said path, an operator can readily place an article to be printed on said platen or remove a printed article from said platen.

15. The printing machine of claim 14 comprising:

a track extending generally along said path which is traversed by said platen as it moves;

said platen including roller means engaging said track whereby said platen is supported on said track as it moves along said path.

16. The printing machine of claim 15 in which said track comprises a front portion corresponding to said front segment of said path and a rear portion corresponding to said rear segment of said path; said rear portion of said track being positioned at an elevation such that said platen is oriented generally horizontally as it traverses said rear portion of said track; said front portion of said track being positioned at a lower elevation than said rear portion whereby as said platen moves onto said front portion of said track, it pivots into a downwardly inclined position whereby it can pass beneath said printing head without engaging it, except when said lifting means is activated to lift it into engagement with said printing head.

17. The printing machine of claim 16 comprising:

a plurality of said platens and a plurality of said printing heads, said printing heads all being located over said front portion of said path.

18. The printing machine of claim 14 comprising:

a plurality of said platens and a plurality of said printing heads, said printing heads all being located over said front portion of said path.

19. The apparatus of claim 6 in which said path defines a continuous loop having spaced front and rear segments, said printing head being located over said front segment and said rear segment of said path being free of obstructions whereby when said platen is located along said rear segment of said path, an operator can readily place an article to be printed on said platen or remove a printed article from said platen.

20. The printing machine of claim 19 comprising:

a track extending generally along said path which is traversed by said platen as it moves;

said platen including roller means on said track whereby said platen is supported on said track as it moves along said first path.

21. The printing machine of claim 20 in which said track comprises a front portion corresponding to said front segment of said path and a rear portion corresponding to said rear segment of said path; said rear portion of said track being positioned at an elevation such that said platen is oriented generally horizontally as it traverses said rear portion of said track; said front portion of said track being positioned at a lower elevation than said rear portion whereby as said platen moves onto said front portion of said track, it pivots into a downwardly inclined position whereby it can pass beneath said printing head without engaging it, except when said lifting means is activated to lift it into engagement with said printing head.

22. The printing machine of claim 21 comprising:

a plurality of said platens and a plurality of said printing heads, said printing heads all being located over said front portion of said path.

23. The printing machine of claim 19 comprising:

a plurality of said platens and a plurality of said printing heads, said printing heads all being located over said front portion of said path.

24. The apparatus of claim 3 in which said path defines a continuous loop having spaced front and rear segments, said printing head being located over said front segment and said rear segment of said path being free of obstructions whereby when said platen is located along said rear segment of said path, an operator can readily place an article to be printed on said platen or remove a printed article from said platen.

25. The printing machine of claim 24 comprising:

a track extending generally along said path which is traversed by said platen as it moves;

said platen including roller means whereby said platen is supported on said track as it moves along said path.

26. The printing machine of claim 25 in which said track comprises a front portion corresponding to said front segment of said path and a rear portion corresponding to said rear segment of said path; said rear portion of said track being positioned at an elevation such that said platen is oriented generally horizontally as it traverses said rear portion of said track; said front portion of said track being positioned at a lower elevation than said rear portion whereby as said platen moves onto said front portion of said track, it moves into a downwardly inclined position whereby it can pass beneath said printing head without engaging it, except when said lifting means is activated to lift it into engagement with said printing head.

27. The printing machine of claim 26 comprising:

a plurality of said platens and a plurality of said printing heads, said printing heads all being located over said front portion of said path.

28. The printing machine of claim 24 comprising:

a plurality of said platens and a plurality of said printing heads, said printing heads all being located over said front portion of said path.

29. The apparatus of claim 1 in which said path defines a continuous loop having spaced front and rear segments, said printing head being located over said front segment and said rear segment of said path being free of obstructions whereby when said platen is located along said rear segment of said path, an operator can readily place an article to be printed on said platen or remove a printed article from said platen.

30. The printing machine of claim 29 comprising:

a track extending generally along said path which is traversed by said platen as it moves;

said platen including roller means engaging said track whereby said platen is supported on said track as it moves along said path.

31. The printing machine of claim 30 in which said track comprises a front portion corresponding to said front segment of said path and a rear portion corresponding to said rear segment of said path; said rear portion of said track being positioned at an elevation such that said platen is oriented generally horizontally as it traverses said rear portion of said track; said front portion of said track being positioned at a lower elevation than said rear portion whereby as said platen moves onto said front portion of said track, it moves into a downwardly inclined position whereby it can pass beneath said printing head without engaging it, except when said lifting means is activated to lift it into engagement with said printing head.

32. The printing machine of claim 31 comprising:

a plurality of said platens and a plurality of said printing heads, said printing heads all being located over said front portion of said path.

33. The printing machine of claim 29 comprising:

a plurality of said platens and a plurality of said printing heads, said printing heads all being located over said front portion of said path.

34. The printing machine of claim 1 comprising:

a plurality of said platens and a plurality of said printing heads, said printing heads all being located over said front portion of said path.

35. A printing machine comprising:

a base;

a plurality of printing heads fixedly mounted to said base and having means for printing a pattern on an article;

at least one platen having means for mounting thereon the article to be printed;

motive means for moving said platen;

lateral indexing means for accurately aligning said platen with said printing head when said platen is moved to engage said printing head, said lateral indexing means including first cooperating means secured to each said printing head and second cooperating means secured to said platen;

longitudinal indexing means, said longitudinal indexing means comprising first and second cooperating means on said printing head and said platen respectively;

whereby said platen is individually indexed into accurate lateral and longitudinal alignment at each said printing head with which it engages by the cooperative interaction of said first and second cooperating means of said lateral and longitudinal indexing means;

one of said first and second cooperating means of said lateral indexing means including a pair of indexing blocks which define therebetween a channel, and the other of said first and second cooperating means including a protuberant bar which is shaped to interact with said indexing blocks to laterally shift said platen if said article is not accurately aligned laterally with said printing means when said motive means moves said platen into engagement with said printing head, such that said bar is thereby matingly received within said channel to positively and accurately position the article laterally with said printing means; and said first and second cooperating means of said longitudinal indexing means being defined by one of said bar and one said indexing block including a laterally projecting knob, and the other of said bar and one said indexing block including a depression, wherein said knob is shaped to interact with said depression and longitudinally shift said platen if said article is not accurately aligned longitudinally with said printing means when said motive means moves said platen into engagement with said printing head such that said knob is thereby matingly received within said depression to positively and accurately position the article longitudinally with said printing means.

36. The printing machine of claim 35 in which said motive means for moving said platen includes a lifting means for moving said platen into engagement with said printing heads, and an endless chain having a plurality of links and pins, wherein at least one pin is elongated to extend beyond said links; and in which said platen includes an aperture which loosely receives said elongated pin therethrough for attaching said platen to said chain for moving said platen from printing head to printing head, and to provide said platen with the freedom of motion to move into engagement with said printing heads.

37. A printing machine comprising:

a base;

a plurality of printing heads fixedly mounted to said base and having means for printing a pattern on an article;

at least one platen having means for mounting thereon the article to be printed;

motive means for moving said platen;

indexing means for accurately aligning said platen with said printing head when said platen is moved to engage said printing head, said indexing means including a first indexing assembly secured to each said printing head and a second indexing assembly secured to said platen, whereby said platen is individually indexed into accurate alignment at each said printing head with which it engages by the cooperative interaction of said first and second index assemblies;

said motive means for moving said platen including a lifting means for moving said platen into engagement with said printing heads, and an endless chain having a plurality of links and pins, wherein at least one is elongated to extend beyond said links; and in which said platen includes an aperture which loosely receives said elongated pin therethrough for attaching said platen to said chain for moving said platen from printing head to printing head, and to provide said platen with the freedom of motion to move into engagement with said printing heads;

said lifting means including a head which is adapted to engage and raise said platen to its horizontal orientation through a linear vertical movement of said head and an arcuate swinging motion top said platen, said head includes a groove having a top defining wall, and said platen further includes a lowering flange which is adapted to swing into said groove as said platen is raised, and is adapted to engage said top defining wall when said platen is lowered if said platen sticks to said printing head, whereby said platen can thereby be positively lowered from said printing head.

38. A printing machine comprising:

a base;

a plurality of printing heads fixedly mounted to said base and having means for printing a pattern on an article;

at least one platen having means for mounting thereon the article to be printed;

motive means for moving said platen;

indexing means for accurately aligning said platen with said printing head when said platen is moved to engage said printing head, said indexing means including a first indexing assembly secured to each said printing head and a second indexing assembly secured to said platen, whereby said platen is individually indexed into accurate alignment at each said printing head with which it engages by the cooperative interaction of said first and second index assemblies; and a track having first and second portions, said second portion positioned to underlie said printing heads, and wherein said first portion of said track is positioned at a higher elevation than said second portion thereof; and in which said platen includes means for attaching said platen to said motive means and roller means for rolling engaging said track for movement therealong, wherein said platen is oriented horizontally when traversing said first portion of said track to facilitate easy mounting of the article thereon, and is oriented in a downwardly inclined position when traversing said second portion of said track so that said platen clears said printing heads as it moves from printing head to printing head.

* * * * *

UNITED STATES PATENT AND TRADEMARK OFFICE

CERTIFICATE OF CORRECTION

PATENT NO. : 4,920,878

DATED : May 1, 1990

INVENTOR(S) : Charles W. Harpold and James Belcher

It is certified that error appears in the above-identified patent and that said Letters Patent is hereby corrected as shown below:

Column 1, line 34:
"frames" should read --frame--;

Column 8, claim 3, line 24:
"a" should read --said--

Column 8, claim 3, line 24:
"said: should read --a--

Column 13, claim 37, line 21:
After "one" insert --pin--;

Column 13, claim 37, line 31:
"top" should read --to--;

Column 14, claim 38, line 28:
"rolling" should read --rollingly--.

Signed and Sealed this

Third Day of March, 1992

*Attest:*

HARRY F. MANBECK, JR.

*Attesting Officer*

*Commissioner of Patents and Trademarks*